United States Patent [19]

Magnuson et al.

[11] Patent Number: 4,666,858

[45] Date of Patent: May 19, 1987

[54] DETERMINATION OF AMOUNT OF ANIONIC MATERIAL IN A LIQUID SAMPLE

[75] Inventors: Roy H. Magnuson, Binghamton; Steven A. Schubert, Vestal, both of N.Y.

[73] Assignee: International Business Machines Corporation, Armonk, N.Y.

[21] Appl. No.: 663,114

[22] Filed: Oct. 22, 1984

[51] Int. Cl.[4] ..... G01N 1/18

[52] U.S. Cl. ..... 436/104; 436/164; 436/178; 436/140; 210/639; 356/36; 427/8

[58] Field of Search ..... 436/104, 164, 178, 140, 436/141; 356/36; 427/8, 345; 210/639

[56] References Cited

U.S. PATENT DOCUMENTS

| | | | |
|---|---|---|---|
| Re. 29,039 | 11/1976 | Andrews | 204/30 |
| Re. 31,694 | 10/1984 | Slominski et al. | 427/8 |
| 3,215,622 | 11/1965 | Dunning et al. | 210/639 |
| 3,326,700 | 6/1967 | Zeblisky | 106/1 |
| 3,485,643 | 12/1969 | Zeblisky et al. | 106/1 |
| 3,532,519 | 10/1970 | Hirohata et al. | 106/1 |
| 3,607,317 | 9/1971 | Schneble, Jr. | 106/1 |
| 3,615,737 | 10/1971 | Schneble Jr., et al. | 106/1 |
| 3,790,392 | 2/1974 | Gilano | 106/1 |
| 3,844,799 | 10/1974 | Underkofler et al. | 106/1.26 |
| 3,951,602 | 4/1976 | Thompson | 436/164 |
| 3,963,610 | 6/1976 | Hauschulz et al. | 210/639 |
| 3,966,410 | 6/1976 | Jahnsen | 23/230 |
| 3,966,594 | 6/1976 | Ohkawa et al. | 210/639 |
| 3,992,149 | 11/1976 | Wang | 436/164 |
| 4,096,301 | 6/1978 | Slominski et al. | 427/430 |
| 4,118,234 | 10/1978 | Jans | 106/1.23 |
| 4,125,642 | 11/1978 | Petii et al. | 427/8 |
| 4,152,467 | 5/1979 | Alpaugh et al. | 106/1.25 |
| 4,165,218 | 8/1979 | Vanyumbeeck et al. | 23/230 |
| 4,221,659 | 9/1980 | Harris et al. | 210/639 |
| 4,229,971 | 10/1980 | Ririe, Jr. | 73/61 R |
| 4,276,323 | 6/1981 | Oka et al. | 427/8 |
| 4,279,948 | 7/1981 | Kukanskis et al. | 427/305 |
| 4,286,965 | 9/1981 | Vanhumbeeck et al. | 23/230 A |
| 4,301,196 | 11/1981 | McCormack et al. | 427/305 |
| 4,310,563 | 1/1982 | Oka et al. | 427/8 |
| 4,324,589 | 4/1982 | Gulla et al. | 106/1.22 |
| 4,325,990 | 4/1982 | Ferrier | 427/305 |
| 4,326,940 | 4/1982 | Eckles et al. | 427/8 |
| 4,341,634 | 7/1982 | Matsushita et al. | 210/656 |
| 4,350,717 | 9/1982 | Araki et al. | 427/8 |
| 4,353,933 | 10/1982 | Araki et al. | 427/8 |
| 4,384,471 | 5/1983 | Wentzel | 73/23.1 |
| 4,391,841 | 7/1983 | Zeblisky | 427/12 |
| 4,544,639 | 10/1985 | Faust | 436/104 |

FOREIGN PATENT DOCUMENTS

| | | | |
|---|---|---|---|
| 118854 | 10/1978 | Japan | 210/639 |
| 47866 | 4/1979 | Japan | 210/639 |

*Primary Examiner*—David L. Lacey

*Attorney, Agent, or Firm*—Pollock, Vande Sande & Priddy

[57] ABSTRACT

The quantity of an anionic material in a sample is determined by adjusting the pH of the sample to place the material in nonionic extractable form, extracting out the material, spectrophotometrically measuring the extracted material, and comparing the measured value to a standard in order to determine the quantity of the anionic material.

20 Claims, 3 Drawing Figures

Methylene chloride absorbance spectra obtained by extracting a Gafac-containing plating solution at five different pHs: A = pH 3, B = pH 4, C = pH 5, D = pH 6, and E = pH 7.

Methylene chloride absorbance spectra obtained by extracting a Gafac-containing plating solution at five different pHs: A = pH 3, B = pH 4, C = pH 5, D = pH 6, and E = pH 7.

Plot of absorbance versus concentration for methylene chloride extracts of Gafac standards ranging in concentration from 1-210 ppm.

Expanded plot of absorbance versus concentration for methylene chloride extracts of Gafac standards in the concentration range of 1-10.5 ppm. The solid line represents the best least squares fit to the data. The dashed lines denote the upper and lower limits of the 95% confidence band.

DETERMINATION OF AMOUNT OF ANIONIC MATERIAL IN A LIQUID SAMPLE

DESCRIPTION

1. Technical Field

The present invention is concerned with a process for determining the quantity of anionic materials in a sample and is especially concerned with determining the quantity of phosphate esters of nonionic surfactants of the ethylene oxide adduct type, such as phosphonated polyoxyethylenated alkylphenols or metal salts thereof. The present invention is particularly concerned with determining the quantity of such materials in electroless metal plating baths 2. Background Art Surface-active agents or surfactants have application in a number of industrial products and processes. Surfactants fall into three basic categories which are detergents, wetting agents, and emulsifiers. Such materials, although typically employed in relatively low amounts, can significantly influence the behavior of a process or a product.

The analysis of surfactants depends, to a large extent, on the composition in which such is present In the simplest situations, physical properties, such as surface tension or polarographic adsorption can be used to determine the amount of surfactant present in a composition. Unfortunately, these test procedures are relatively non-specific and can be influenced greatly by variables other than the concentration of the surfactant. For instance, solution temperature, ionic strength and specific gravity are among the factors that are often difficult to control.

Chemical methods of analysis are not free from interferences, but they do manage to avoid many of the problems of physical methods by monitoring characteristic functional groups, such as phosphates, sulfates, or amines. These methods usually depend upon a prior separation, digestion, or complexing step to isolate the materials of interest.

Plating bath compositions are among the more difficult compositions for determining the amount of surfactants present in view of the types of materials and physical characteristics of the compositions. However, the concentration of each chemical component of a plating composition should, desirably, be measured regularly and tightly controlled within specified limits. This is due to the fact that the stability of plating baths, and especially electroless plating baths, and the quality of the plated metal, such as copper produced, is highly dependent upon the chemical composition of the baths. The behavior is such that even small variations in the concentrations of even minor constituents can have a significant impact upon the bath performance.

One important constituent of electroless plating baths, an anionic surfactant, and especially the phosphated polyoxyethylenated alkylphenol and metal salts thereof, have eluded direct quantitative analysis for several years. An early attempt to indirectly determine such material by surface tension measurements was unsuccessful due to the fact that such measurements are influenced greatly by variables other than surfactant concentration.

Examples of electroless copper plating baths employing such surfactants can be found in U.S. Pat. Nos. 3,844,799 and 4,152,467, disclosures of which are incorporated herein by reference.

SUMMARY OF THE INVENTION

The present invention is concerned with a process for determining the quantity of an anionic material in a sample. The process comprises adjusting the pH of the sample to place said material in extractable form and then extracting out the material, the quantity of which is to be determined, thereby obtaining an extract. The extract is then measured spectrophotometrically and the measured value is compared to a standard to determine the quantity of the anionic material.

DESCRIPTION OF VARIOUS AND PREFERRED EMBODIMENTS

Figure 1:
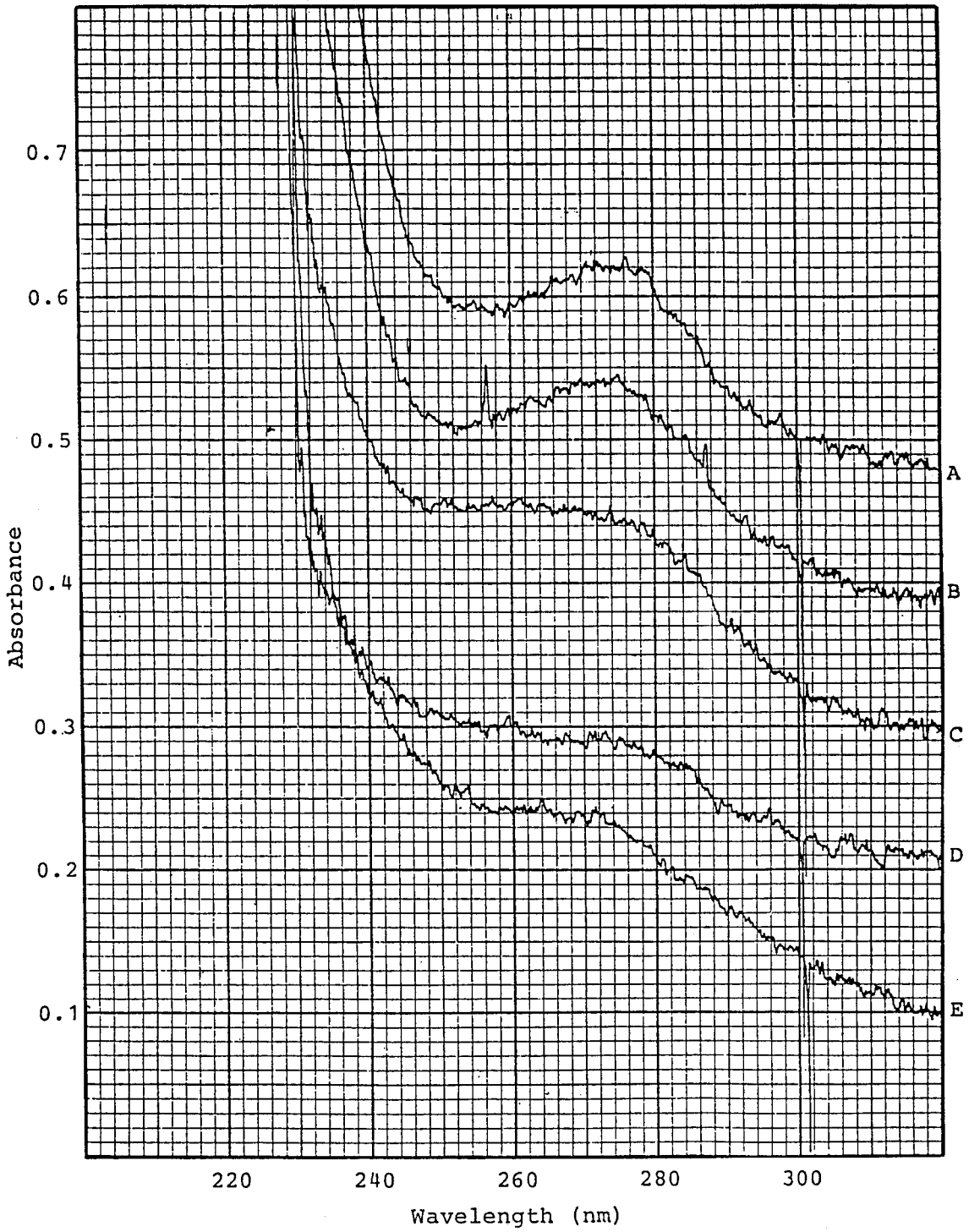
FIG. 1 is an absorbance spectra plotting absorbance versus wavelength of samples of varying pH.

The process of the present invention is concerned with determining the quantity in a sample of anionic materials and especially the quantity of phosphate esters of nonionic surfactants of ethylene oxide adduct type such as the phosphated polyoxyethylenated alkylphenols or metal salts thereof. The present invention is preferably concerned with determining the amount of such in an electroless plating bath, such as an electroless copper plating bath. The preferred aromatic materials, the quantity of which is determined, contain anionic functionality. The phosphated polyoxyethylenated alkylphenols and metal salts thereof are well-known materials and have been used as surface-active agents in electroless copper plating baths. A number of these materials are commercially available under the trade designation GAFAC and are available from GAF Corporation. Such materials can be represented by the following structural formula:

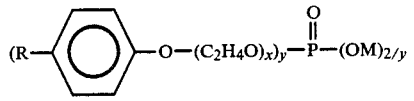

wherein R is an alkyl radical. R usually contains 1–12 carbon atoms and more usually 1–5 carbon atoms, M is H or a metal, such as an alkali metal such as sodium.

Y is 1 or 2.

X is the average number of molecules of ethyleneoxide reacted with one molecule of the hydrophobe, such as being from 1 to about 20 and usually from about 5 to about 15.

Additional discussion of GAFAC surfactants can be found in the publication *GAFAC Anionic Surfactants*, "A Series of Complex Organic Phosphate Esters", available from GAF Corporation and from page 527 of Rosen, et al., "Systemic Analysis of Surface-Active Agents", Second Edition, Wiley, Interscience Publishers, New York, N.Y., 1972, disclosures of which are incorporated herein by reference.

One particular surfactant employed under the trade designation GAFAC RE-610 has been analyzed to indicate that the R group is predominantly a butyl group and the amount of ethylene oxide groups is predominately about 9 moles per mole of hydrophobe.

The preferred compositions analyzed for the amount of anionic material according to the present invention are electroless plating baths. Examples of copper electroless plating baths are in U.S. Pat. Nos. 3,844,799 and 4,152,467, disclosures of which are incorporated herein by reference.

Copper electroless plating baths are generally aqueous compositions which contain a source of cupric ion, a reducing agent, a complexing agent for the cupric ion, and a pH adjustor. The plating baths also include a surface-active agent and, preferably, a cyanide ion source.

The cupric ion source generally used is cupric sulfate or a cupric salt of the complexing agent to be employed.

When employing cupric sulfate, it is preferred to use amounts from about 3 to about 15 gram/liter and most preferably, about 8 to about 12 gram/liter.

The most common reducing agent employed is formaldehyde which is usually used in amounts from about 0.7 to about 7 gram/liter and more usually, from about 0.7 to about 2.2 gram/liter.

Examples of some other reducing agents include formaldehyde precursors or derivatives such as paraformaldehyde, trioxane, dimethylhydantoin, and glyoxal; borohydrides such as alkali metal borohydrides (sodium and potassium borohydride) and substituted borohydrides such as sodium trimethoxy borohydrides; and boranes such as amine borane (isopropyl amine borane and morpholine borane).

Examples of some complexing agents include Rochelle salts, ethylenediaminetetraacetic acid, the sodium (mono-, di-, tri-, and tetra- sodium) salts of ethylenediaminetetraacetic acid, nitrilotriacetic acid and its alkali salts, gluconic acid, gluconates, triethanol amine, glucono (gamma)-lactone, modified ethylene diamine acetates such as N-hydroxyethyl ethylene diamine triacetate. Moreover, a number of other cupric complexing agents are suggested in U.S. Pat. Nos. 2,996,408; 3,075,856; 3,075,855; and 2,938,805. The amount of complexing agent is dependent upon the amount of cupric ions present in the solution and is generally from about 20 to about 50 gram/liter.

The plating bath can include an anionic surfactant which assists in wetting the surface to be coated. A satisfactory surfactant is, for instance, an organic phosphate ester, available under the trade designation GAFAC RE-610. Generally, the surfactant is present in amounts from about 0.02 to about 0.3 gram/liter.

In addition, the pH of the bath is generally controlled, for instance, by the addition of a basic compound such as sodium hydroxide or potassium hydroxide in the desired amount to achieve the desired pH. The preferred pH of the electroless plating bath is between 11.6 and 11.8.

Also, preferably, the plating bath contains a cyanide ion and most preferably, contains about 10 to about 25 milligrams/liter to provide a cyanide ion concentration in the bath within the range of 0.0002 to 0.0004 molar. Examples of some cyanides which can be employed are the alkali metal, alkaline earth metal, and ammonium cyanides. In addition, the plating bath can include other minor additives as is known in the art.

These plating baths employed generally have a specific gravity within the range of 1.06 to 1.08.

Also, the $O_2$ content of the bath can be maintained between 2 ppm and 4 ppm during plating, as discussed in U.S. Pat. No. 4,152,467. The $O_2$ content can be controlled by injecting oxygen and an inert gas such as nitrogen into the bath. The overall flow rate of the gases into the bath is generally from about 1 to about 20 SCFM per thousand gallons of bath.

The process of the present invention requires that the sample to be tested has its pH adjusted to a value to place the anionic material in extractable form. In addition, the pH adjustment should not cause precipitation of any of the other materials in the sample being tested. In the preferred aspects of the present invention, the pH is adjusted to a value of 4 or less prior to the extraction. This is in order to assure that the phosphated polyoxyethylenated alkylphenol is in the non-ionic form such that the M of the structure defined by Formula I is hydrogen. In addition, for those compositions which contain a complexing agent, such as ethylenediaminetetraacetic acid (EDTA), the pH should not be below 3 since EDTA begins to precipitate out of the solution. This could cause interference with the measuring procedures. In the most preferred aspects of the present invention the pH is 3 to 4 in order to assure that in the preferred compositions treated (the electroless copper plating baths) the complexing agent, such as the ethylenediaminetetraacetic acid will not precipitate out of the solution, thereby causing problems with respect to accuracy of the test.

The pH of the bath is preferably acidified to a pH of about 3 to 4 with an inorganic acid, such as sulfuric acid, and hydrochloric acid, with sulfuric acid being most preferred. The volume concentration of the sulfuric acid employed is usually about 10% to about 25%. Only several drops of acid are usually required to adjust the pH of composition to 3 to 4.

After the pH of the sample is adjusted to the desired level, the composition is contacted with a solvent, such as in a separatory funnel, which solvent is capable of extracting out the neutralized anionic material (i.e., now in the non-ionic form) without also extracting out those materials of the composition which could interfere with the spectrophotometric analysis. Such materials which are not to be extracted out include cupric sulfate which, because of its absorbance characteristics, would interfere with the values measured for materials of the phosphated polyoxyethylenated alkylphenol type. A preferred organic extracting solvent is methylene chloride. The relative amount, by volume, of solvent, with respect to the amount of sample, is usually about 1:1 to about 0.5:1.

After thorough contact of the extracting solvent and the composition, the materials are permitted to stand and then separate into two distinct phases. The more dense methylene chloride phase contains the surface-active agent and settles to the bottom of the separatory funnel. The potentially interfering species of the plating bath, such as the cupric sulfate and ethylenediaminetetraacetic acid remain behind in the upper aqueous phase.

The extracted phase containing the neutralized anionic material, the amount of which is to be determined, is separated from the aqueous phase and then the amount is determined by a spectrophotometric determination, particularly by the U.V. absorbance at about 255 to about 280 nm and at room temperature. When analyzing for GAFAC RE-610 it is preferred to measure absorbance at about 276 nm.

In the experiments discussed hereinbelow, the ultraviolet absorption can be measured with a Beckman model 26 spectrophotometer. The region from 240 to 320 nm was scanned at a rate of 20 nm/minute and the resulting absorbance spectra recorded with a wavelength resolution of 20 nm/inch.

The determination can be made by taking a small amount of the extract, such as a few milliliters, and placing it directly in a quartz cuvette and measuring the ultraviolet absorbance at the suitable wavelength of, for instance, 276 nm. In order to minimize evaporation of solvent, it is suggested to fit the reference cell with a Teflon stopper.

Next, the value obtained is compared to a suitable calibration curve or standard and the concentration is then determined.

Figure 2:
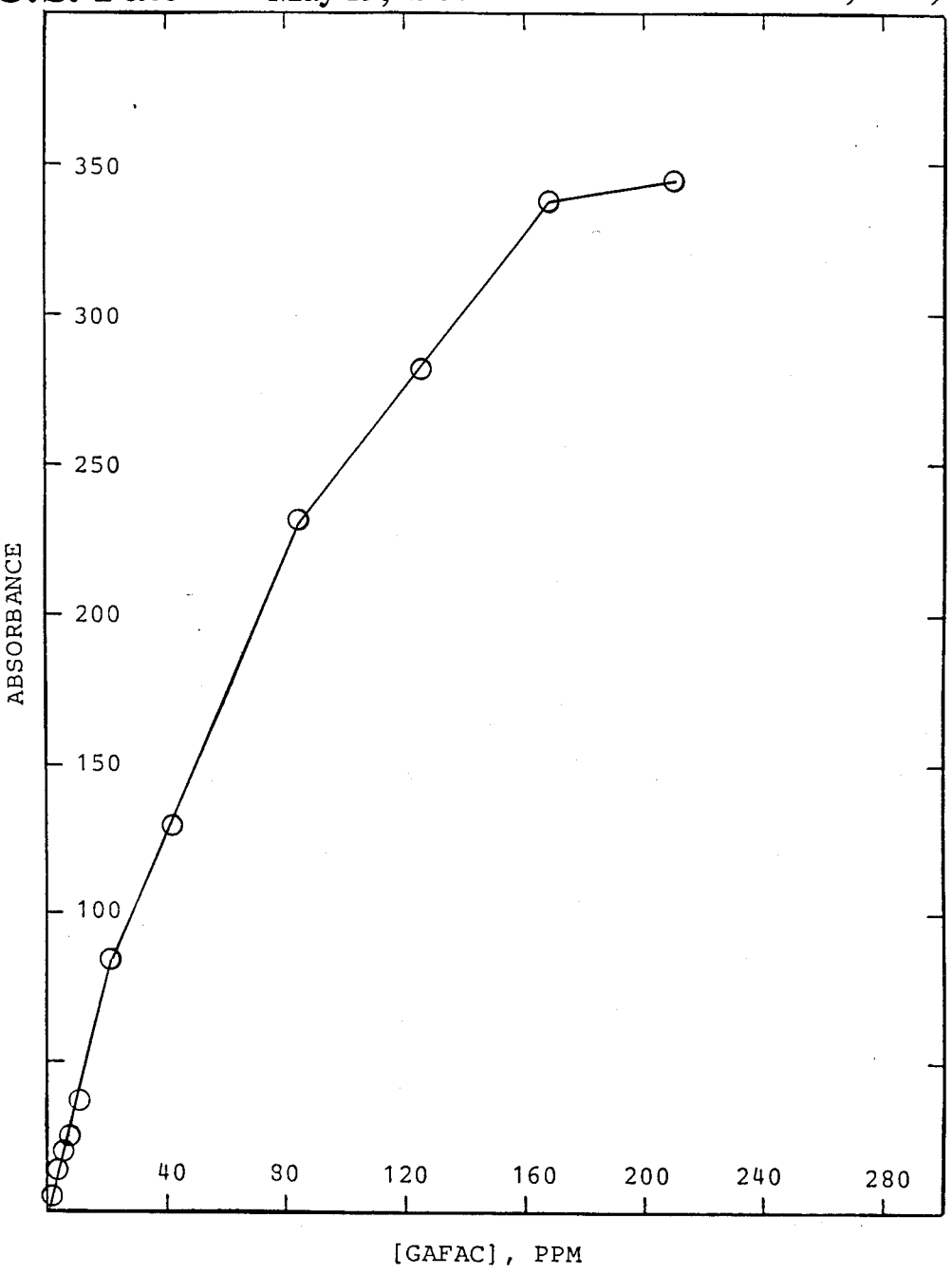
FIG. 2 is a plot of absorbance versus concentration for extracts of surfactant.

FIG. 2 represents a plot of absorbance versus concentration for a series of standards containing varying amounts of GAFAC RE-610 over the range of 1 to 210 ppm. Absorbance in FIG. 2 is reported as millimeters of height of peak at 276 nm, but can be represented in any units desired as long as they are consistent for all of the samples. The standard solution employed to begin the extraction process contained a known amount of GAFAC RE-610 in deionized water mixed with ethylenediaminetetraacetic acid (about 0.14 molar) and cupric sulfate (about 0.04 molar). The samples were adjusted to a pH of 4 with dilute (25% by volume) aqueous sulfuric acid. The samples were then extracted with glass-distilled methylene chloride. The extractions were carried out at normal room-temperature, for instance, 22±2° C. Except for concentrations which are less than 15 ppm, the relationship is non-linear. The relative precision at the 10 ppm level is about ±6.5% (which is sufficiently accurate for most analytical applications). A graph along the lines of FIG. 2 can be used as a standard for determining the amount of the anionic material in a sample.

Figure 3:
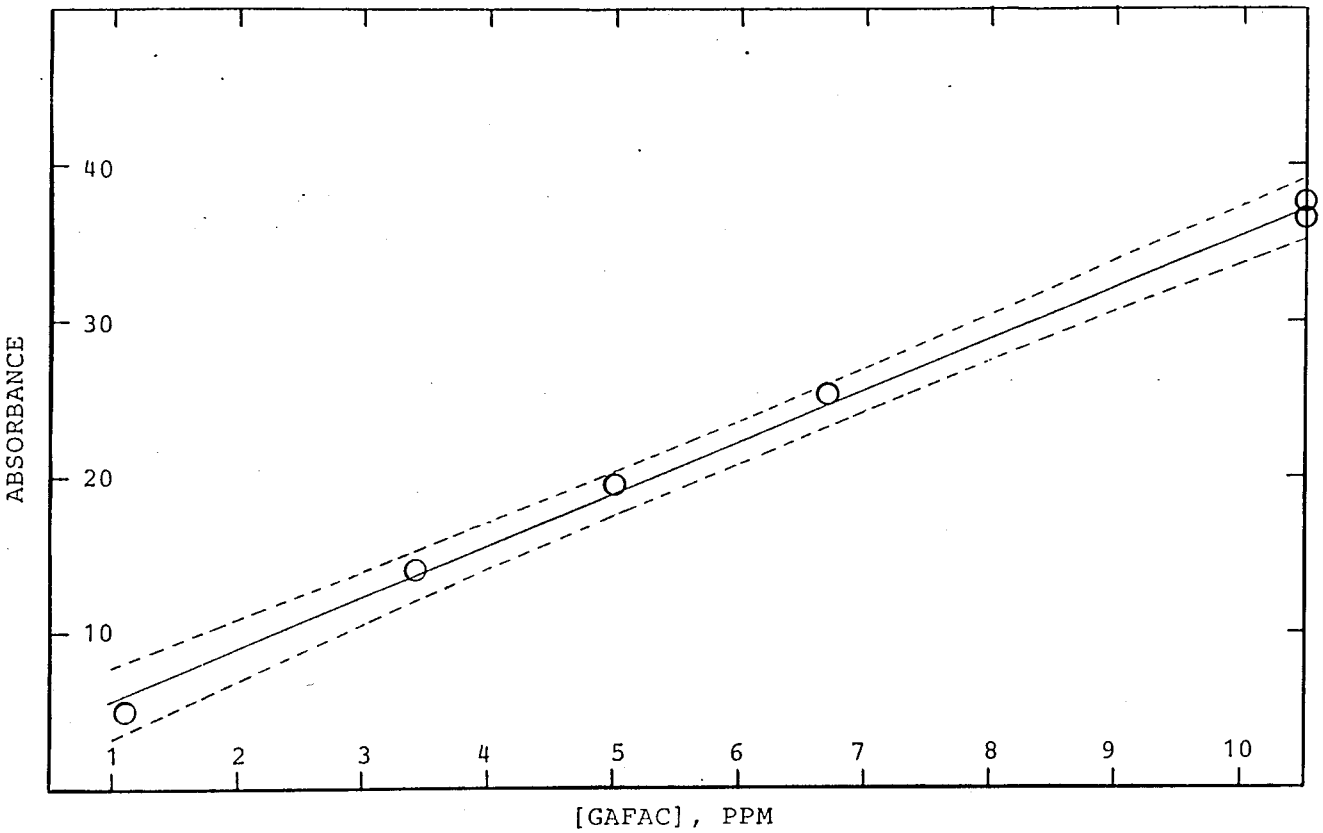
FIG. 3 is another plot of absorbance versus concentration.

FIG. 3 is an enlarged plot of the absorbance versus concentration for the region below 15 ppm which is extremely linear and is believed to be the region of highest sensitivity. Absorbance is reported as millimeters of height of peak at 276 nm.

The present invention is particularly applicable for those levels of surfactant which are believed to be in the range of 0.6 to 170 ppm. Around 200 ppm there is somewhat of a loss in sensitivity which is probably due to combined effects of additional factors, such as interactions between the surfactant and other materials in the solution or a marked change in the refractive index of the solution.

However, the technique of the present invention is still applicable to amounts of 200 ppm and above and any loss in sensitivity can be compensated for by merely increasing the amount of dilution with the extracting solvent.

The solid line represents the best least squares fit to the data. The dashed lines denote the upper and lower limits of the 95% confidence band.

FIG. 1 is an absorbance spectrum wavelength for compositions containing GAFAC RE-610 being extracted at five different pH levels. The curve designated as "A" represents a pH of 3, the curve designated as "B" represents a pH of 4, the curve designated as "C" represents a pH of 5, the curve designated as "D" represents a pH of 6, and the curve designated as "E" represents a pH of 7. As apparent from FIG. 1, the pH of the extraction is critical in determining the concentration of the desired surfactant. In particular, curves C, D, and E do not demonstrate sufficient peaks around the 276 nm wavelength to be able to detect the presence of the desired surfactant.

Having thus described our invention, what we claim as new and desire to secure by Letters Patent is:

1. A method for determining the quantity of an anionic material in a liquid sample which comprises adjusting the pH of the sample to place said anionic material in a nonionic extractable form; extracting out the material in its extractable form from said liquid sample with a solvent; spectrophotometrically measuring the ultraviolet absorption of the extracted material; and comparing the measured value to a standard to thereby determine the quantity of said anionic material.

2. The method of claim 1 wherein said anionic material has aromatic functionality.

3. The method of claim 1 wherein said anionic material is a phosphated polyoxyethylenated alkylphenol or metal salt thereof.

4. The method of claim 3 wherein the pH of the sample adjusted to a value of 4 or less.

5. The method of claim 1 wherein said anionic material is represented by the formula:

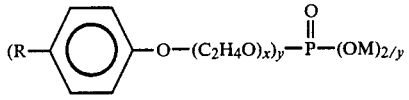

wherein R is an alkyl group containing 1–12 carbon atoms; M is H or a metal; Y is 1 or 2; and X is an integer from 1 to about 20.

6. The method of claim 5 wherein said sample is an aqueous electroless copper plating bath.

7. The method of claim 6 wherein said bath contains a cupric ion source, a reducing agent, a complexing agent, and said anionic surfactant.

8. The method of claim 7 wherein said complexing agent is ethylenediaminetetraacetic acid.

9. The method of claim 8 wherein the bath as a pH of 11.6 to 11.8.

10. The method of claim 8 wherein the pH of the sample is adjusted to a value of 3 to 4.

11. The method of claim 5 wherein the ultraviolet absorbance at about 276 nm of the extracted material is measured.

12. The method of claim 1 wherein said sample is an electroless plating bath.

13. The method of claim 1 wherein said solvent is methylene chloride.

14. The method of claim 1 wherein the relative amount of solvent to sample is about 1:1 to about 0.5:1 by volume.

15. The method of claim 1 wherein the ultraviolet absorbance at about 255 to about 280 nm of the extracted material is measured.

16. The method of claim 1 wherein the quantity of said anionic material is in the range of 0.6 to 170 ppm.

17. The method of claim 1 wherein the extraction and spectrophotometric measuring are carried out at normal room temperature.

18. The method of claim 1 wherein the step of adjusting the pH of the sample comprises adding an inorganic acid to the sample

19. The method of claim 18 wherein said inorganic acid is hydrochloric acid or sulfuric acid.

20. The method of claim 1 wherein said liquid sample is an aqueous composition.

* * * * *